US009184010B2

(12) United States Patent
To et al.

(10) Patent No.: US 9,184,010 B2
(45) Date of Patent: Nov. 10, 2015

(54) RAPID TRI-STATE BIDIRECTIONAL SWITCHING DEVICE

(71) Applicant: TECHNOLOGY POWER INTERNATIONAL LIMITED, Kwai Chung, Kowloon (HK)

(72) Inventors: ManFuk To, Kowloon (HK); Kenny Ho, Kowloon (HK)

(73) Assignee: TECHNOLOGY POWER INTERNATIONAL LIMITED, Hong Kong (HK)

( * ) Notice: Subject to any disclaimer, the term of this patent is extended or adjusted under 35 U.S.C. 154(b) by 0 days.

(21) Appl. No.: 14/451,647

(22) Filed: Aug. 5, 2014

(65) Prior Publication Data

US 2015/0109079 A1 Apr. 23, 2015

(30) Foreign Application Priority Data

Oct. 18, 2013 (CN) ..... 2013 1 0492317

(51) Int. Cl.

| | |
|---|---|
| ***H01H 51/22*** | (2006.01) |
| ***H01H 1/50*** | (2006.01) |
| ***H01H 3/28*** | (2006.01) |
| ***H01H 5/06*** | (2006.01) |
| ***H01H 15/06*** | (2006.01) |
| ***H01H 51/26*** | (2006.01) |

(52) U.S. Cl.

CPC ..... *H01H 51/2209* (2013.01); *H01H 1/50* (2013.01); *H01H 3/28* (2013.01); *H01H 5/06* (2013.01); *H01H 15/06* (2013.01); *H01H 51/26* (2013.01); *H01H 2300/018* (2013.01)

(58) Field of Classification Search

CPC ..... H01H 1/50; H01H 3/28; H01H 5/06; H01H 51/26; H01H 51/2209; H01H 15/06; H01H 2300/018

USPC ..... 335/180, 185, 189, 255, 273

See application file for complete search history.

(56) References Cited

U.S. PATENT DOCUMENTS

| | | | | | |
|---|---|---|---|---|---|
| 900,658 | A * | 10/1908 | Bristol | 361/210 |
| 1,275,047 | A * | 8/1918 | Krantz | 335/180 |
| 1,337,285 | A * | 4/1920 | Sperry | 335/114 |
| 1,916,942 | A * | 7/1933 | Wright | 335/180 |
| 1,927,775 | A * | 9/1933 | Fitzgerald | 335/167 |
| 2,223,105 | A * | 11/1940 | Howe | 335/180 |
| 3,352,983 | A * | 11/1967 | Cools | 200/83 R |
| 5,512,869 | A * | 4/1996 | Thuries | 335/177 |
| 6,348,847 | B1 * | 2/2002 | Nakajima et al. | 335/195 |

* cited by examiner

*Primary Examiner* — Mohamad Musleh

(74) *Attorney, Agent, or Firm* — Erickson Kernell Derusseau & Kleypas, LLC

(57) ABSTRACT

The invention relates to a rapid tri-state bidirectional switching device with three switching states of forward, backward and idle connection positions, comprising a shell and a movable electrode arranged within the shell for switching among the three states, wherein the movable electrode is provided with a movable contact point at either end thereof, the shell is provided with a fixed contact point at the front and rear sides thereof respectively corresponding to the movable contact points, a driving solenoid shaft is arranged above and connected to the movable electrode housing, and provided with a front locking notch and a rear locking notch, the device further comprises a release lock cooperating with a front locking notch and a rear locking notch to lock the movable electrode housing. The rapid bidirectional tri-state switching device is advantageous for its short switching time, small size and contact reliability.

5 Claims, 4 Drawing Sheets

RAPID TRI-STATE BIDIRECTIONAL SWITCHING DEVICE

CROSS-REFERENCE TO RELATED APPLICATION

This application claims priority from Chinese Patent Application No. 201310492317.7 filed Oct. 18, 2013.

FIELD OF THE INVENTION

The invention relates to a dual-power switching device, in particular to a rapid tri-state bidirectional switching device.

BACKGROUND OF THE INVENTION

With increased reliance on electronic devices, various industries have higher and higher requirements on reliability of the power supply. Two power supplies have been used in various applications to ensure the reliability of the power supply using a dual-power switch, which is capable of carrying out reliable switching between the two power supplies. Currently, the common dual-power switching switchgear mainly comprises a motor, two circuit breakers, an electric operation mechanism and a controller, wherein two circuit breakers are respectively connected to the two power supplies. When one power supply fails and needs to be switched, the motor drives the electric operation mechanism. The electric operation mechanism is rotated by the motor under the control of the controller to switch on the circuit breaker to the good power supply and switch off the circuit breaker to the failed power supply, and consequently switch the load circuit to the good power supply from the failed power supply. These prior art dual-power switches have several deficiencies. First, the switching time of these dual-power switches is relatively long. The switching time of a common dual-power switch is in the range of a few to tens of seconds, and currently, the fastest dual-power switch has a switching time of two seconds and is relatively expensive. For some precise instruments and in some places where power needs to be stably supplied, restoration time of power after failure should be within several periods, i.e. tens of milliseconds, after which the power needs to be supplied again. Second, the size of these dual-power switches is relatively large. Due to inclusion of two circuit breakers, the switch is large, so that only one dual-power switch can be installed in a power distribution cabinet.

SUMMARY OF THE INVENTION

To overcome the deficiencies in the prior art, the present invention provides a rapid tri-state bidirectional switching device with a short switching time, small size and reliable contact.

The rapid tri-state bidirectional switching device has three switching states, forward, backward and idle connection positions. The device may include a shell, a movable electrode housing, which is transversely moveable within the shell for switching between forward, backward and idle positions, a movable electrode, which is arranged in the movable electrode housing, movable contact points, arranged at both ends of the movable electrode; fixed contact points, arranged at opposite sides of the shell and corresponding to the movable contact points; fixed contact outlets, connected to the fixed contact points, respectively; movable electrode release springs, arranged at the opposite sides of the shell respectively, wherein the movable electrode housing compresses the movable electrode release springs during transverse movement; a driving solenoid shaft connected to the movable electrode housing, and driven by a front driving solenoid and a rear driving solenoid to cause the movable electrode to move back and forth and thus moving the contact points into contact with the fixed contact points arranged at the opposite sides of the shell; and a locking mechanism, including a front locking notch and a rear locking notch, and a release lock for engaging with or disengaging from the front locking notch and the rear locking notch, for locking the movable electrode.

The device may further include electrode springs sleeved on the movable electrode, and an electrode spring stop arranged on the movable electrode between the electrode springs for transferring the biasing force from the springs to the movable electrode.

The device may further include a release solenoid, arranged at the top of the shell for resetting the movable electrode to the idle position from the forward or backward positions. The front driving solenoid and the rear driving solenoid may be arranged in the upper portion of the shell and respectively provided with a guide hole with an opening opposite each other, in which a driving solenoid shaft is arranged When a pulse current is supplied to the front driving solenoid, or rear driving solenoid, and release solenoid, the movable electrode moves bi-directionally so as to achieve the operation of switching over the forward/backward/idle connection positions. In the process of the switching the device, the movement speed of the movable electrode is increased by means of the springs. When the movable electrode completes a switching action, the locking notches and the release lock are firmly clamped with each other to ensure sufficient pressure between the main contacts and the fixed contacts to provide a reliable connection. Moreover, after the movable electrode is locked, the pulse current is no longer required to retain the movable electrode in its current position/state, such that the rapid tri-state bidirectional switching device is also advantageous for energy saving. As compared with a conventional dual-power switch equipped with two circuit breakers, the rapid tri-state bidirectional switching device according to the invention is simple in structure, easy to implement, compact, and suitable for large-scale deployment.

BRIEF DESCRIPTION OF THE DRAWINGS

The invention will now be explained in more detail with reference to figures illustrated in the drawings, wherein.

DETAILED DESCRIPTION OF THE EMBODIMENTS

Figure 1:
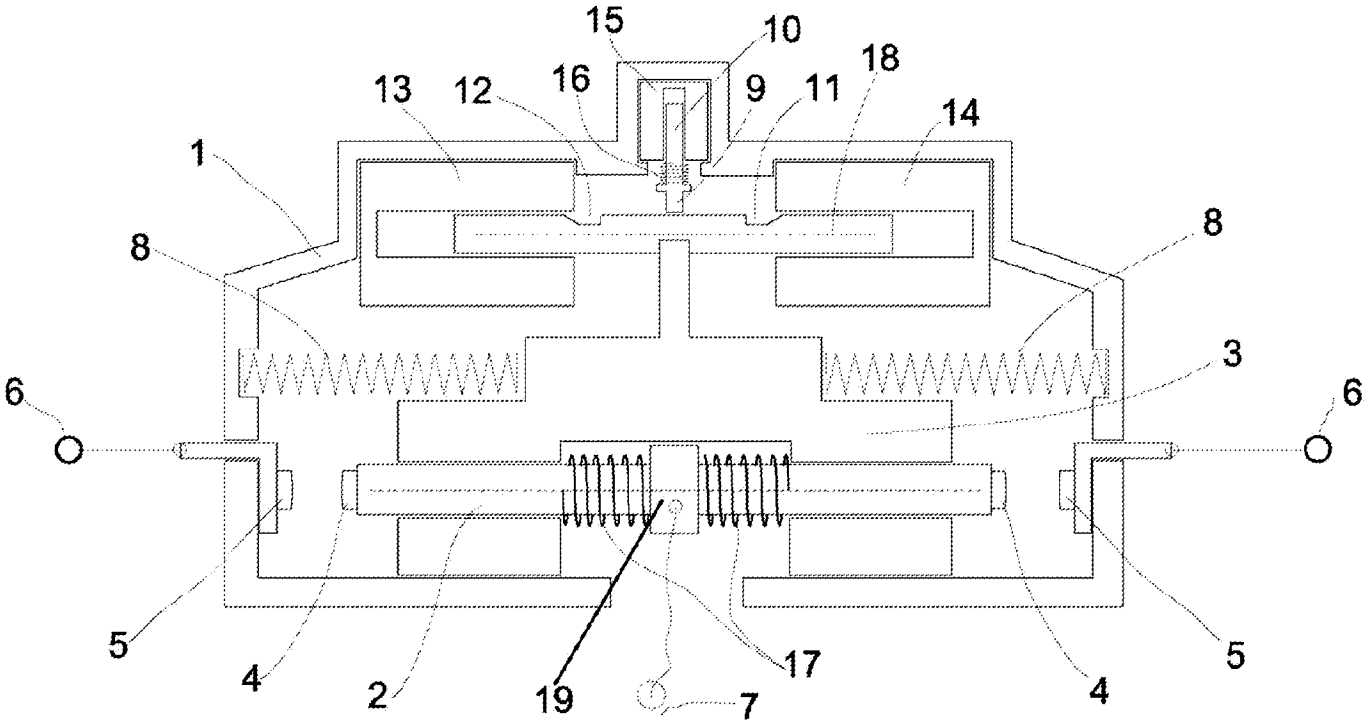
FIG. 1 is a schematic view of a rapid tri-state bidirectional switching device according to the invention in the idle connection state.
Figure 2:
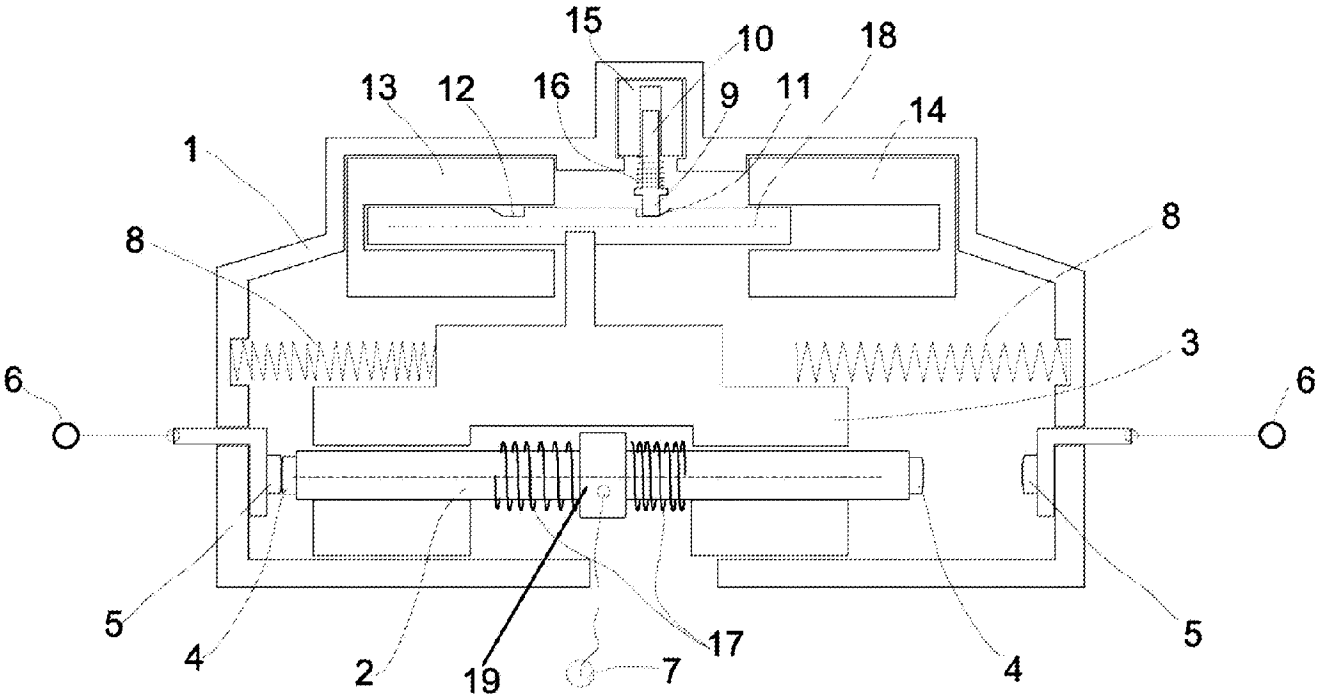
FIG. 2 is a schematic view of the rapid tri-state bidirectional switching device in the forward state.
Figure 3:
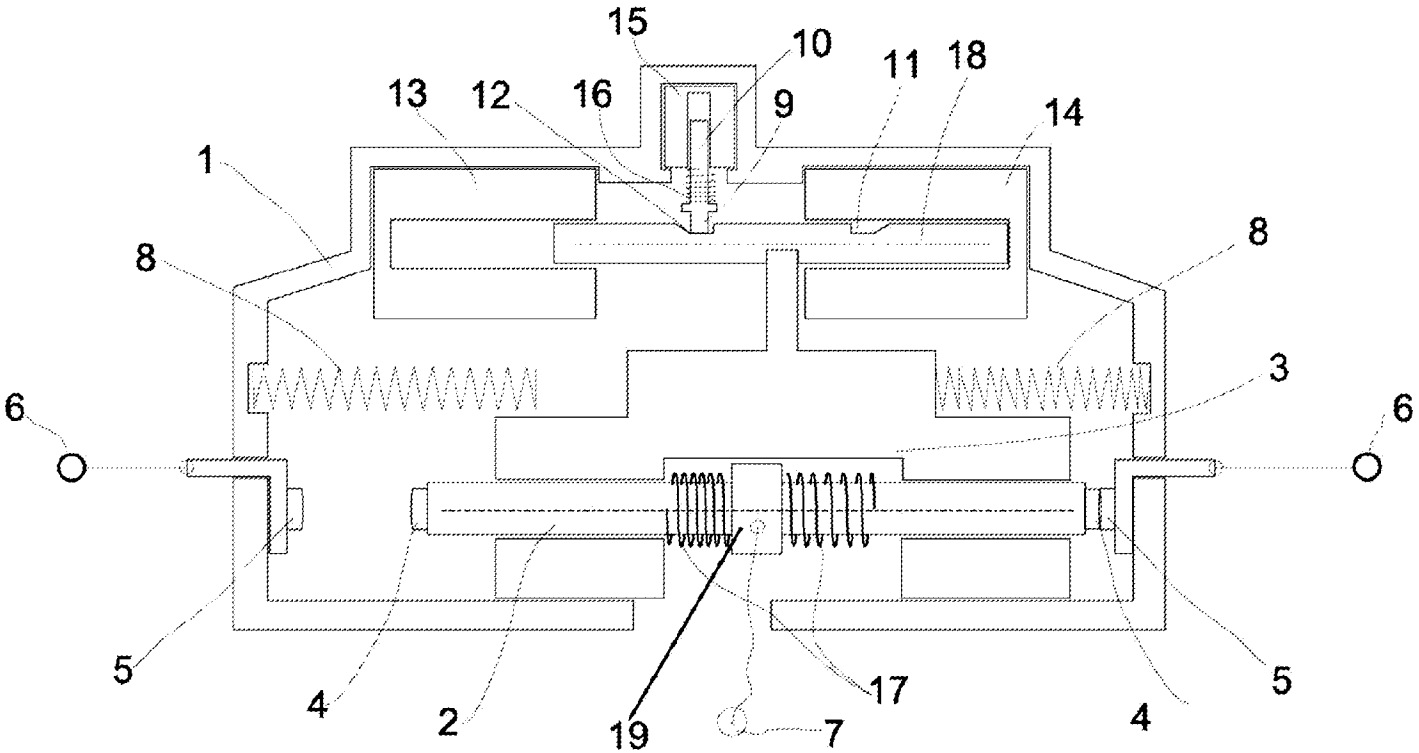
FIG. 3 is a schematic view of the rapid tri-state bidirectional switching device in the backward state.

With reference to FIGS. 1 to 3, a rapid tri-state bidirectional switching device according to the present invention may operate in three switching states including forward, backward and idle connection positions. The device includes a shell 1, a movable housing 3, which is transversely movable inside the shell 1 for switching between the three positions, and a movable electrode 2 which is arranged in the movable electrode housing 3. The movable electrode 2 is provided with a movable contact point 4 at each end thereof, and accordingly the shell 1 is provided with a fixed contact point 5 respectively at opposite sides thereof corresponding to the movable contact points 4. Each of the two fixed contact points 5 is connected with a fixed contact outlet or terminal 6. The movable electrode 2 is connected to a moveable contact outlet or terminal 7 by a wire. The shell 1 also includes two movable electrode release springs 8 at opposite sides of the shell 1. The movable electrode housing 3 compresses the movable electrode release springs 8 while moving transversely within the shell 1. The movable electrode 2 is sleeved with two electrode springs 17, and an electrode spring stop 19 for transferring the biasing force or pressure from the electrode springs 17 to the movable electrode 2.

A solenoid driving shaft 18 is arranged above and connected to the movable electrode housing 3. The solenoid driving shaft 18 may be driven by a front driving solenoid 13 and a rear driving solenoid 14 so as to cause the movable contact points 4 of the movable electrode 2 to come into contact with the fixed contact points 5 arranged at opposite sides of the movable electrode housing 3. The front driving solenoid 13 and the rear driving solenoid 14 are arranged in the upper portion of the shell 1, and a release solenoid is arranged at the top of the shell 1 for resetting the movable electrode 2 to the idle position from the forward or backward positions. The front driving solenoid 13 and the rear driving solenoid 14 are respectively provided with a guide hole having an opening opposite to one another, in which a driving solenoid shaft 18 is arranged. The release solenoid 15 is provided with a guide hole having a downward opening, in which a release solenoid shaft 10 is arranged. The driving solenoid shaft 18 is provided with a front locking notch 11 and a rear locking notch 12 respectively arranged on the opposite ends of the solenoid shaft 18. The release solenoid shaft 10 includes a release lock 9 at one end for engaging into or disengaging from the front locking notch 11 and the rear locking notch 12 to lock the movable electrode housing 3 in position. The release solenoid shaft 10 is sleeved with a release solenoid spring 16, which is limited between the release lock 9 and the guide hole of the release solenoid 15.

Figure 4:
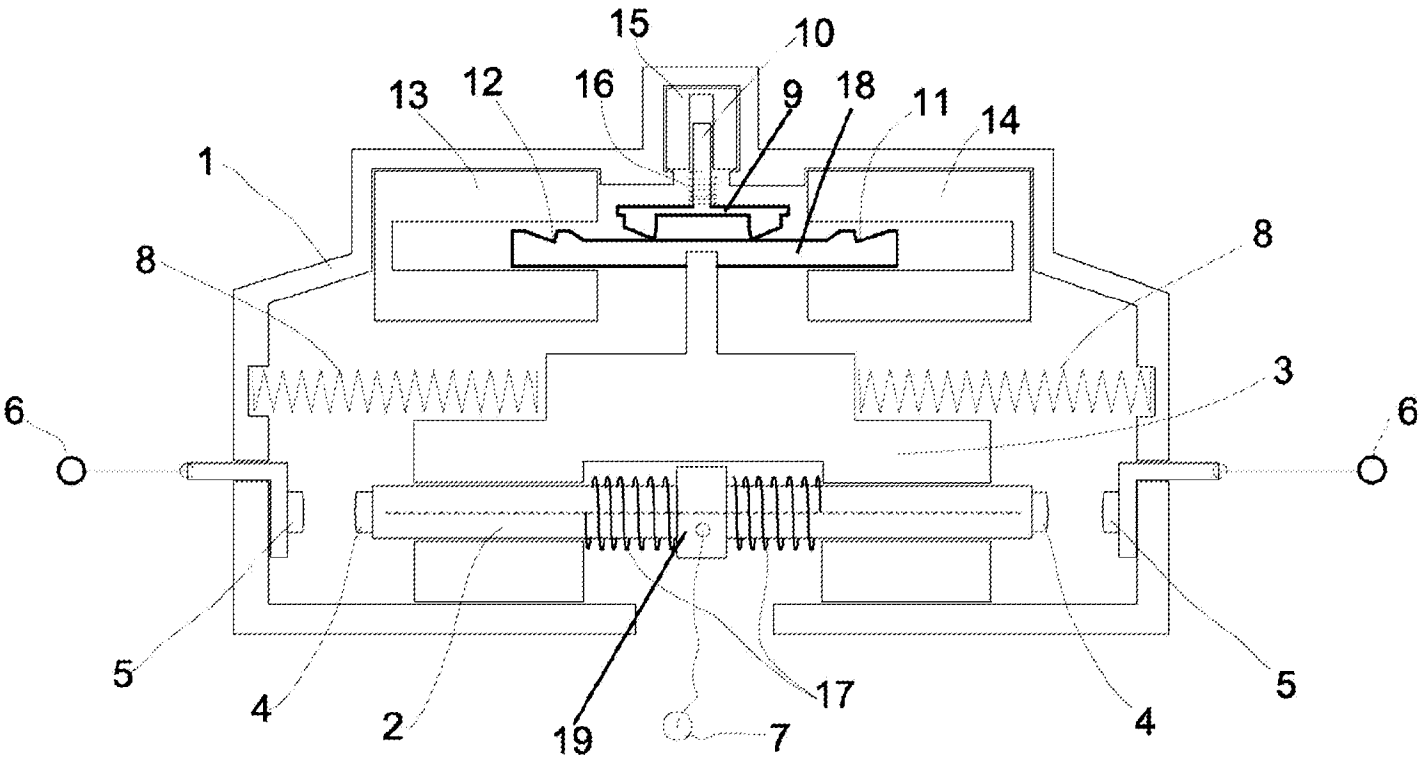
FIG. 4 is a schematic view of a rapid tri-state bidirectional switching device in another embodiment according to the present invention.

Referring to FIG. 4, another embodiment of the present invention is illustrated. The release solenoid shaft 10 has a horizontal portion 9 at the bottom thereof, by which the release solenoid spring 16 is restricted under the guide hole, each end of the horizontal portion 9 is provided with a wedge engaging into the front locking notch 11 or the rear locking notch 12.

In operation, the rapid tri-state bidirectional switching device is connected to a controller. When the controller receives a signal from an external source to switch the power source, the controller outputs a pulse current to the front driving solenoid 13, the rear driving solenoid 14 or the release solenoid 15 so as to control the movable electrode 2 to move into a desired position switching among the three states of forward, backward and idle connection, respectively. Operation of the rapid tri-state bidirectional switching device may be described as follows:

To move the movable electrode 2 forward, i.e. the device is instructed to connect to a front power source, the controller outputs a pulse current to the front driving solenoid 13, which generates a magnetic force on the driving solenoid shaft 18. Driven by the driving solenoid shaft 18, the movable electrode housing 3 and the movable electrode 2 are moved forwards, and thus the movable contact point 4 at the front end of the movable electrode 2 comes into contact with the fixed contact point 5 at the front side of the shell 1. Simultaneously, the release lock 9 is firmly engaged with the front locking notch 11. The rapid tri-state bidirectional switching device not only provides sufficient pressure between the movable contact point 4 and the fixed contact point 5 to provide a reliable contact, but also enables the movable electrode 2 to remain in place after the current to the front solenoid 13 is cut off, thus saving energy.

While the moveable electrode 2 and the movable electrode housing 3 are moving forward, both the movable electrode release spring 8 at the front side of the shell 1 and the electrode spring 17 on the movable electrode 2 are compressed, elastic potential energy is thus stored in the movable electrode release spring 8 and the electrode spring 17.

To move the movable electrode 2 backward, i.e. the device is instructed to connect to a rear power source, the controller outputs a pulse current to the rear driving solenoid 14, which generates a magnetic force on the driving solenoid shaft 18. Driven by the driving solenoid shaft 18, the movable electrode housing 3 and the movable electrode 2 are moved backwards. At the same time, the elastic potential energy previously stored in the movable electrode release spring 8 at the front side of the shell 1 and the electrode spring 17 on the movable electrode 2 is released and converted into kinetic energy to speed up the motion of the movable electrode housing 3 and the movable electrode 2, thereby rapidly switching to the rear power source. At this point, the movable contact point 4 at the rear end of the movable electrode 2 is in contact with the fixed contact point 5 at the rear side of the shell 1, and the release lock 9 is engaged with the rear locking notch 12.

While the movable electrode 2 and movable electrode housing 3 are moving backwards, both the movable electrode release spring 8 at the rear side of the shell 1 and the electrode spring 17 on the movable electrode 2 are compressed. The elastic potential energy is thus stored in both the movable electrode release spring 8 and the electrode spring 17.

Likewise, to move the movable electrode 2 to the middle position, i.e. the device is instructed to switch to the idle connection state, the controller outputs a pulse current to the reset release solenoid 15, which generates a magnetic force on the release solenoid shaft 10. Driven by the release solenoid shaft 10, the release lock 9 is disengaged from the front locking notch 11 or the rear locking notch 12. The movable electrode housing 3 and the movable electrode 2 rapidly move back to the middle under the action of elastic forces from the movable electrode release spring 8 and the electrode spring 17.

The above is only the preferred embodiments of the invention, the invention is not restricted to the embodiments shown, but also extends to other preferred embodiments falling within the scope of the appended claims. Further, the use of terms such as first, second, front, rear, bottom, top, etc., are for descriptive and illustrative purposes only, and are not limiting.

What is claimed as new and desired to be secured by Letters Patent is:

1. A tri-state bidirectional switching device with three switching states of forward, backward and idle connection positions, comprising:

a shell having opposite sides;

an electrode housing moveable within said shell for switching between forward, backward and idle positions;

an electrode arranged in said electrode housing and having opposite ends;

movable contact points arranged at said opposite ends of said electrode;

fixed contact points arranged at said opposite sides of said shell and corresponding to said movable contact points, respectively;

fixed contact terminals connected to said fixed contact points;

electrode release springs arranged at said opposite sides of said shell, wherein said electrode housing compresses said electrode release springs during movement within said shell;

a driving solenoid shaft connected to said electrode housing, wherein said driving solenoid shaft is driven by a front driving solenoid and a rear driving solenoid to cause said electrode to move back and forth, such that one of said movable contact points contacts one of said fixed contact points arranged at said opposite sides of said shell; and a locking mechanism, having a front locking notch and a rear locking notch, and a release lock engaging or disengaging from said front locking notch and said rear locking notch.

2. The tri-state bidirectional switching device of claim 1, further comprising:

electrode springs sleeved on said electrode, and an electrode spring stop arranged on said electrode for transferring a biasing force from said electrode springs to said electrode.

3. The tri-state bidirectional switching device of claim 1, further comprising:

a release solenoid arranged at a top of said shell and operable to reset the movable electrode to said idle position from said forward or backward positions;

wherein said front driving solenoid and said rear driving solenoid are arranged in an upper portion of said shell and respectively provided with a guide hole having an opening opposite to one another, in which a driving solenoid shaft is received, said release solenoid having a guide hole receiving a release solenoid shaft coupled to said release lock.

4. The tri-state bidirectional switching device of claim 3, further comprising a release solenoid spring sleeved on said release solenoid shaft and retained between said release lock and said guide hole of said release solenoid.

5. The tri-state bidirectional switching device of claim 1, wherein said movable electrode is electrically connected to a contact terminal.

* * * * *